United States Patent [19]

Peterson et al.

[11] 4,242,935

[45] Jan. 6, 1981

[54] MUSICAL TONE GENERATOR SYSTEM USING MULTIPLE FREQUENCY SYNTHESIZERS

[76] Inventors: Richard H. Peterson, 11748 Walnut Ridge Rd.; Robert A. Finch, 12219 S. 89th Ave., both of Palos Park, Ill. 60464

[21] Appl. No.: 827,655

[22] Filed: Aug. 25, 1977

Related U.S. Application Data

[63] Continuation of Ser. No. 678,358, Apr. 19, 1976, abandoned.

[51] Int. Cl.[3] ..... G10H 1/10; G10H 5/00

[52] U.S. Cl. ..... 84/1.01; 84/1.24; 84/DIG. 4

[58] Field of Search ..... 84/1.01, 1.22–1.24, 84/DIG. 4, DIG. 11

[56] References Cited

U.S. PATENT DOCUMENTS

| | | | |
|---|---|---|---|
| 3,795,754 | 3/1974 | Mochida | 84/1.01 |
| 3,809,787 | 5/1974 | Mochida | 84/1.01 |
| 3,828,109 | 8/1974 | Morez | 84/1.01 |
| 4,056,995 | 11/1977 | Uetrecht | 84/1.01 |

*Primary Examiner*—Stanley J. Witkowski
*Attorney, Agent, or Firm*—Spencer E. Olson

[57] ABSTRACT

For generating tones in an electronic musical instrument, there are provided multiple master frequency sources, a different source for each octave, differing in frequency from each other by a factor which differs from two by at least one semitone, each of which is coupled to a respective frequency synthesizer all of which have the same dividing ratios, to divide down the frequency of its master frequency source to pitches of the twelve notes in the intended octave. In one embodiment the sources are separate master clock pulse sources, and in another embodiment a pulse train derived from a single clock pulse source is applied to the frequency synthesizer for the highest octave, and the pulse train applied to each of the other synthesizers is derived from the pulse train supplied to the frequency synthesizer for the next highest octave by dividing the pulse repetition frequency thereof by a factor which differs from two by one or more semitones. The result is that temperament errors are randomized by placing them at different interval locations in each octave, and corresponding musical tones of successive octaves are not locked in phase relationship but have frequencies which differ slightly from pure harmonics, so as to present a pleasant chorus effect when such tones are reproduced simultaneously.

8 Claims, 2 Drawing Figures

MUSICAL TONE GENERATOR SYSTEM USING MULTIPLE FREQUENCY SYNTHESIZERS

This application is a continuation of application Ser. No. 678,358, filed Apr. 19, 1976, and now abandoned.

BACKGROUND OF THE INVENTION

1. Field of the Invention

The present invention relates to electronic musical instruments, and more particularly to electronic organs and the like in which the musical tones for a plurality of separate octaves are synthesized by frequency synthesizers.

2. The Prior Art

Electronic musical instruments, such as electronic pianos and organs, typically employ a unit called a "top octave frequency synthesizer" for deriving twelve output signals having frequencies corresponding to the musical tones of the highest octave of the instrument by dividing the output of a master clock source by predetermined dividing factors. Signals having frequencies corresponding to the musical tones of the second highest octave are derived from the outputs of the top octave synthesizer by dividing the pulse repetition rate of the outputs of the top octave synthesizer by a factor of two to derive a series of output signals having frequencies equal to one-half the frequencies of the output signals of the top octave synthesizer. Signals for the lower octaves are derived in a similar fashion. In this type system, the relationship between corresponding tones of different octaves is exact, and the corresponding tones of each octave are locked into a precise phase relationship with each other. The frequencies of the tones produced by such an instrument are accurate and serve efficiently to produce musical sounds either singly or in combination. However, when two or more corresponding tones from separate octaves are sounded simultaneously, the result is different than that obtainable in sounding corresponding tones from separate octaves by means of a non-electronic musical instrument, such as a pipe organ, for example. When a non-electronic musical instrument is employed, the corresponding tones are not precise harmonics of each other, but differ slightly therefrom, producing a chorus effect.

It is known from U.S. Pat. No. 3,828,109 to modify the just-described system so as to provide a rolling or moving chorus effect to the musical tones produced thereby. The tone generator described therein employs a plurality of frequency synthesizers, one for each octave of musical tones to be generated in the musical instrument, a source of clock pulses having a pulse repetition rate which is a multiple of the highest frequency desired for the musical tones, the frequency synthesizer for the octave having the highest frequencies being connected to the source, and a plurality of frequency dividers connected in cascade relationship for successively dividing the pulse repetition rate of the pulse train by a factor which differs slightly from two, such frequency dividers being connected individually to the inputs of the frequency synthesizers for the lower octaves. As a result, corresponding musical tones of successive octaves are not locked in phase relationship but have frequencies which differ slightly from pure harmonics so as to present a chorus effect when such tones are reproduced simultaneously.

Although the system of U.S. Pat. No. 3,828,109 overcomes the objection of corresponding musical tones of successive octaves being locked in phase, the chorus effect is limited by the fact that temperament errors in any musical interval are the same in each octave, and if the same interval is sounded simultaneously in different octaves the effect is not the same as that achieved by acoustic instruments in which temperament errors are truly random. In the equitempered scale, each note has a frequency equal to the next lowest frequency multiplied by the twelfth root of two, or 1.0594, an irrational number; accordingly, each note has a precise frequency. However, because of the fact that the frequency-dividing factors of frequency synthesizers are integers, the resultant tones obtained from the frequency synthesizer differ from the corresponding frequencies of the equitempered scale, the amount of the error depending upon the selected frequency of the master oscillator and the dividing factors of the frequency synthesizer used. The error may be in one direction for some of the notes in an octave, and in the opposite direction for others, and the extent of the error may change from note to note. For example, if it is desired to obtain the tones of the twelve notes in the highest octave using the National Semiconductor MM5832/MM5833 frequency synthesizer, and if the frequency of the master frequency oscillator is selected at 2.00024 MHz, twelve tones having frequencies as shown in Table 1 will be obtained. The table also shows the frequencies of the tones in the equitempered scale, the dividing factors of the MM5832/MM5833 frequency synthesizer, and the error (in cents) between the derived frequencies and the frequencies of the equitempered scale.

TABLE 1

| Notes | Dividing Factor | Derived Frequency (Hz) | Equitempered Scale(Hz) | Error (Cents) |
|---|---|---|---|---|
| $C_7$ | 478 | 4184.6 | 4186.0 | −0.56 |
| $C\#_7$ | 451 | 4435.1 | 4434.9 | +0.07 |
| $D_7$ | 426 | 4695.4 | 4698.6 | −1.14 |
| $D\#_7$ | 402 | 4975.7 | 4978.0 | −0.77 |
| $E_7$ | 379 | 5277.7 | 5274.0 | +1.18 |
| $F_7$ | 358 | 5587.3 | 5587.7 | −0.12 |
| $F\#_7$ | 338 | 5917.9 | 5919.9 | −0.57 |
| $G_7$ | 319 | 6270.3 | 6271.9 | −0.43 |
| $G\#_7$ | 301 | 6645.3 | 6644.9 | +0.10 |
| $A_7$ | 284 | 7043.1 | 7040.0 | +0.74 |
| $A\#_7$ | 268 | 7463.6 | 7458.6 | +1.13 |
| $B_7$ | 253 | 7906.1 | 7902.1 | +0.85 |
| $C_8$ | 239 | 8369.2 | 8372.0 | −0.56 |

It will be apparent from this table that the frequency errors fall within the range from −1.14 to +1.18 cents, or a spread of 2.32 cents. While it would seem desirable to have the smallest termperament error possible, this is not necessarily the case in an electronic instrument. Very pleasant chorus effects arise out of the simultaneous sounding of tones having coincident harmonic partials that are slightly detuned from one another. It is generally true that the more such tones as are simultaneously sounded, the more desirable it is that they have errors, and that the departure from true equitemperament be greater, provided that they are random in sense and magnitude.

U.S. Pat. No. 3,809,787 describes a tone generator including a plurality of master oscillators, each for a different octave and the frequencies of each being different from each other by a ratio of 2:1. Each of the master oscillators is coupled to a respective frequency divider unit, each frequency divider having a different frequency dividing ratio and respectively dividing the frequency of its respective master oscillator down to pitches of different notes in its respective octave. Since the same lettered notes in different octaves are obtained by frequency dividing the signals produced by separate master oscillators, they are independent in frequency and phase and produce a chorus effect when two or more tones from separate octaves or when two keys of the same pitch but in different keyboards are sounded simultaneously. This desirable effect is not achieved without cost and/or introduction of disadvantages, to obtain it, it is necessary to provide as many different constructions of frequency divider units as there are octaves in the instrument. It is obviously more expensive to design, manufacture and inventory a plurality of different frequency divider units, each having a dividing ratio different from the others, than it would be to utilize the same frequency divider unit with each of the master oscillators.

U.S. Pat. No. 3,795,754 describes a system for reducing frequency errors in tone generators of the frequency synthesizer type which employs two master oscillators differing in frequency by a semitone and twelve master frequency dividers respectively corresponding to the twelve notes in an octave. The output of the first master oscillator is applied to six of the master frequency dividers respectively having frequency dividing factors to produce every other note along the scale in an octave, and the output of the second master oscillator is applied to the other six master frequency dividers respectively having frequency dividing factors to produce the remainder of the notes in the octave. The frequency dividing factors for the first group of master frequency dividers are the same as for the second group. The frequencies of the twelve tones are further divided by two to produce octaves below the highest octave. Thus, two master oscillators are required, and while the arrangement substantially reduces the frequency errors of the individual notes as compared to the desired frequencies of the equitempered scale, because the tones for the octaves below the highest octave are derived by dividing the outputs of the twelve master frequency dividers, corresponding tones of each octave are phase-locked and thus do not produce the desired chorus effect when two or more tones from separate octaves are sounded simultaneously.

Some high-priced organs use tone generators that employ a separate tunable oscillator for each note of the scale over a range of many octaves, seventy-three or eighty-five oscillators typically being required. It is generally conceded that such instruments produce superior chorus effects as compared to instruments using the above-described frequency synthesizers and dividers, but in addition to being costly, such systems require periodic tuning and adjustment, a time-consuming, painstaking and consequently costly process.

SUMMARY OF THE INVENTION

It is a primary object of the present invention to provide an improved tone generator system having the desirable musical attributes of the independent oscillator system but with the simplicity and reliability and other advantages of the frequency synthesizer type of tone generator.

It is another object of the invention to provide a tone generator having the desirable musical properties of an independent oscillator system that requires at most only a few simple tuning adjustments at the time of manufacture, which ordinarily do not require further periodic adjustment.

Briefly, these and other objects can be achieved by a tone generator which comprises multiple master frequency sources, a different one for each octave, the frequencies of which differ from the highest to the next lowest by a factor which differs from two by at least a semitone. Each of the master frequency sources is coupled to a respective frequency synthesizer, the dividing factors of all of which may be identical, to divide down the frequency of its master frequency source and produce pitches of the twelve notes in the intended octave. In one embodiment, the master frequency sources are separate master oscillators which are individually tunable so as to establish the desired frequency differential. In another embodiment, a pulse train derived from a single clock pulse source is applied to a first frequency synthesizer for the highest octave, and the pulse train applied to each of the other synthesizers is derived from the pulse train supplied to the frequency synthesizer for the next highest octave by dividing the pulse repetition frequency thereof by a factor which differs from two by about a semitone, or alternately, two or more approximate semitones.

DESCRIPTION OF THE PREFERRED EMBODIMENTS

Figure 1:
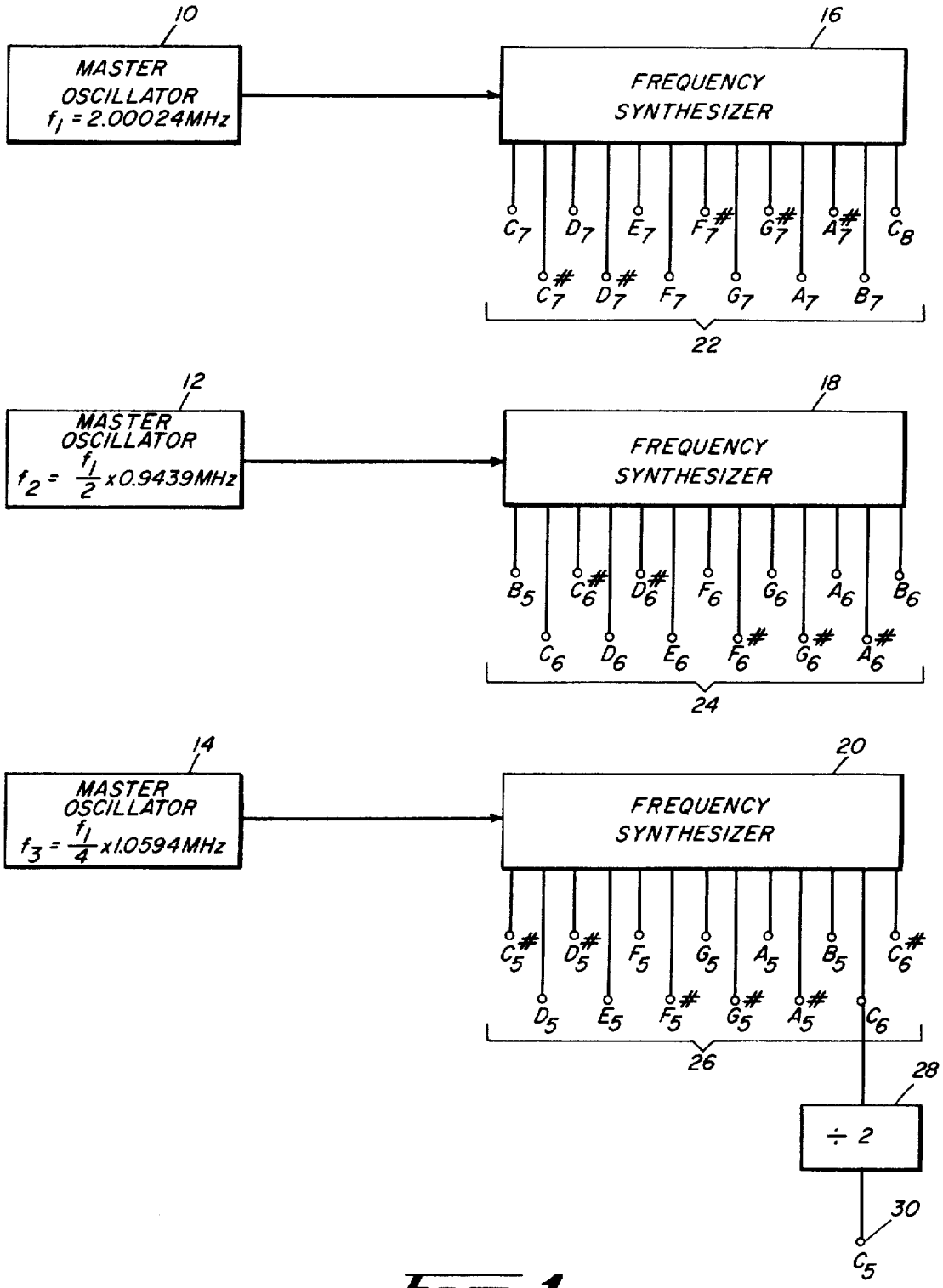
FIG. 1 is a functional block diagram of a tone generator system incorporating a first illustrative embodiment of the present invention.

In the embodiment of the invention shown in FIG. 1, the multiple master frequency sources comprise a plurality of master clock oscillators, one for each octave, three of which are shown at 10, 12 and 14. The master clock oscillators 10, 12 and 14 are each connected to a respective frequency synthesizer 16, 18 and 20, of conventional type, such as the Model MM5832/MM5833 frequency synthesizer as produced by National Semiconductor Corporation, Santa Clara, California, and having the dividing factors set forth in Table 1. Considering first the frequency synthesizer 16, it has thirteen output lines 22, twelve of which are connected to various keyers and other circuitry of the musical instrument in order to furnish the appropriate signals to the output system of the instrument. Signals appearing of the first twelve of output lines 22 have frequencies corresponding (except for the errors indicated in Table 1) to the twelve frequencies of the equitempered scale for the highest octave of the instrument, and the thirteenth has the lowest frequency of the next highest octave. If the frequency $f_1$ of clock oscillator 10 is 2.00024 MHz, for example, the frequencies of the output signals on the output lines 22 vary from 4184.6 Hz to 8369.20 Hz, conforming to note C of adjacent octaves, which are often referred to as $C_7$ and $C_8$, respectively.

The combination of master clock oscillator 12 and frequency synthesizer 18 function to produce on the output lines 24 twelve output frequencies corresponding substantially to the twelve frequencies of the next lowest octave of the musical instrument, plus an extra tone. Heretofore, as exemplified by U.S. Pat. No. 3,809,787, for example, this has been done by utilizing a master oscillator frequency substantially one-half that of the frequency of master oscillator 10. In accordance with the present invention, however, the frequency of oscillator 12 differs from the frequency of oscillator 10 by a factor which differs from two by one or more semitones. In the embodiment illustrated in FIG. 1, the frequency $f_2$ of the oscillator 12 is one-half the frequency of oscillator 10 times 0.9439, the reciprocal of the twelfth root of two, which, for the case of $f_1=2.00024$ MHz, is 1.00012 MHz $\times 0.9439=0.9440$ MHz, or one semitone or approximately six percent below one-half the frequency of oscillator 10. When this master frequency is divided by the factors of the Model MM5832/MM5833 frequency synthesizer, output signals having the frequencies set forth in Table 2 appear on the thirteen output lines 24.

TABLE 2

| | Frequency of Oscillator 12–0.9440 MHz | | |
|---|---|---|---|
| Note | Dividing Factor | Derived Frequency(Hz) | Equitempered Scale(Hz) |
| $B_5$ | 478 | 1974.69 | 1975.53 |
| $C_6$ | 451 | 2092.90 | 2093.01 |
| $C\#_6$ | 426 | 2215.73 | 2217.46 |
| $D_6$ | 402 | 2348.01 | 2349.32 |
| $D\#_6$ | 379 | 2490.50 | 2489.02 |
| $E_6$ | 358 | 2636.59 | 2637.02 |
| $F_6$ | 338 | 2792.60 | 2793.83 |
| $F\#_6$ | 319 | 2958.93 | 2959.96 |
| $G_6$ | 301 | 3135.88 | 3135.96 |
| $G\#_6$ | 284 | 3323.59 | 3322.44 |
| $A_6$ | 268 | 3522.01 | 3520.00 |
| $A\#_6$ | 253 | 3730.83 | 3729.31 |
| $B_6$ | 239 | 3949.37 | 3951.07 |

It will be noted that because the frequency of oscillator 12 is lower than the frequency of oscillator 10 by a semitone more than an octave, the note $B_5$ instead of note $C_6$ appears on the first of the output lines 24; the note $B_5$ would not be used, and the remaining twelve output lines having output signals ranging in frequency from 2092.90 Hz to 3949.37 Hz, conforming to $C_6$ and $B_6$ of the next lowest octave, are connected to various keyers and other circuitry of the musical instrument (not shown).

Comparison of Tables 1 and 2 will reveal that note $C_7$, for example, of the highest octave (4184.60 Hz) is a little out of tune with the second harmonic of note $C_6$ of the next lowest octave (2092.90 Hz), and the same is generally true for corresponding notes in the two different octaves; that is, corresponding musical tones of the successive octaves are not in locked phase relationship but have frequencies which differ from pure harmonics so as to present a chorus effect when such tones are reproduced simultaneously. Moreover, because the dividing factor which produces $C\#_7$ in the highest octave (i.e., 451) produces the note $C_6$ in the next lowest octave (due to shifting of the frequency of oscillator 12 by a semitone more than an octave), an A–D interval, for example, in the highest octave has the same error in the A#–D# interval in the next successive lower octave. Thus, the temperament errors in one octave have been randomized with respect to the temperament errors in the other octave.

Although the frequency of oscillator 12 has been described as being lower by an octave plus a semitone than the frequency of oscillator 10, the advantages of the invention are equally realized by selecting a frequency $f_2$ which is greater than one-half the frequency $f_1$ by a semitone (i.e., $$f_2 = \frac{f_1}{2} \times \sqrt[12]{2}\ ),$$

or $f_2$ can be lower or higher than $\frac{1}{2}$ $f_1$ by two or more semitones; if lower, $$f_2 = \frac{f_1}{2} \times \frac{1}{(\sqrt[12]{2})^n},$$

and if higher, $$f_2 = \frac{f_1}{2} \times (\sqrt[12]{2})^n,$$

the departure from $f_1/2$ in number of semitones corresponding to the exponent n. With this in mind, the frequency $f_3$ of oscillator 14, which together with synthesizer 20 produces the tones of the next successive octave, has a frequency higher by one semitone than one-fourth the frequency of oscillator 10; that is, $$f_3 = 2.00024/4 \times \sqrt[12]{2}$$

or 0.5 MHz$\times$1.0594 or 0.5297 MHz. When the master frequency is divided by the factors of the Model MC1183/MC1184 frequency synthesizer, output signals having the frequencies set forth in Table 3 appear on the thirteen output lines 26.

TABLE 3

| | Frequency of Oscillator 14–.5297 MHz | | |
|---|---|---|---|
| Note | Dividing Factor | Derived Frequency(Hz) | Equitempered Scale(Hz) |
| $C\#_5$ | 478 | 1108.16 | 1108.73 |
| $D_5$ | 451 | 1174.50 | 1174.66 |
| $D\#_5$ | 426 | 1243.43 | 1244.51 |
| $E_5$ | 402 | 1317.66 | 1318.51 |
| $F_5$ | 379 | 1397.92 | 1396.91 |
| $F\#_5$ | 358 | 1479.61 | 1479.98 |
| $G_5$ | 338 | 1567.16 | 1567.98 |
| $G\#_5$ | 319 | 1660.50 | 1661.22 |
| $A_5$ | 301 | 1759.80 | 1760.00 |
| $A\#_5$ | 284 | 1865.14 | 1864.65 |
| $B_5$ | 268 | 1976.49 | 1975.53 |
| $C_6$ | 253 | 2093.68 | 2093.01 |
| $C\#_6$ | 239 | 2216.32 | 2217.46 |

In this case, because the frequency of oscillator 14 is less than two octaves lower than the frequency of oscillator 10 by a semitone, or about six percent higher than $f_1/4$, the note $C\#_5$ instead of $C_5$ appears at the output line corresponding to dividing factor 478, and the other notes of the octave are similarly moved up by a semitone, with $C_6$ and $C\#_6$ appearing on the twelfth and thirteenth terminals, respectively. There is no note $C_5$, but this is readily obtained by dividing the otherwise unneeded $C_6$ note produced by synthesizer 20 by two, using a conventional divide-by-two circuit 28, to produce at terminal 30 a tone having a frequency of 2093.68/2=1046.84 Hz.

The notes for additional desired lower octaves would be produced in similar fashion by additional oscillator-frequency synthesizer combinations, and reducing the frequency of successive master oscillators by an octave plus or minus one or more semitones, and using further divide-by-two circuits as necessary to obtain those notes not directly produced by the conventional frequency synthesizer.

Figure 2:
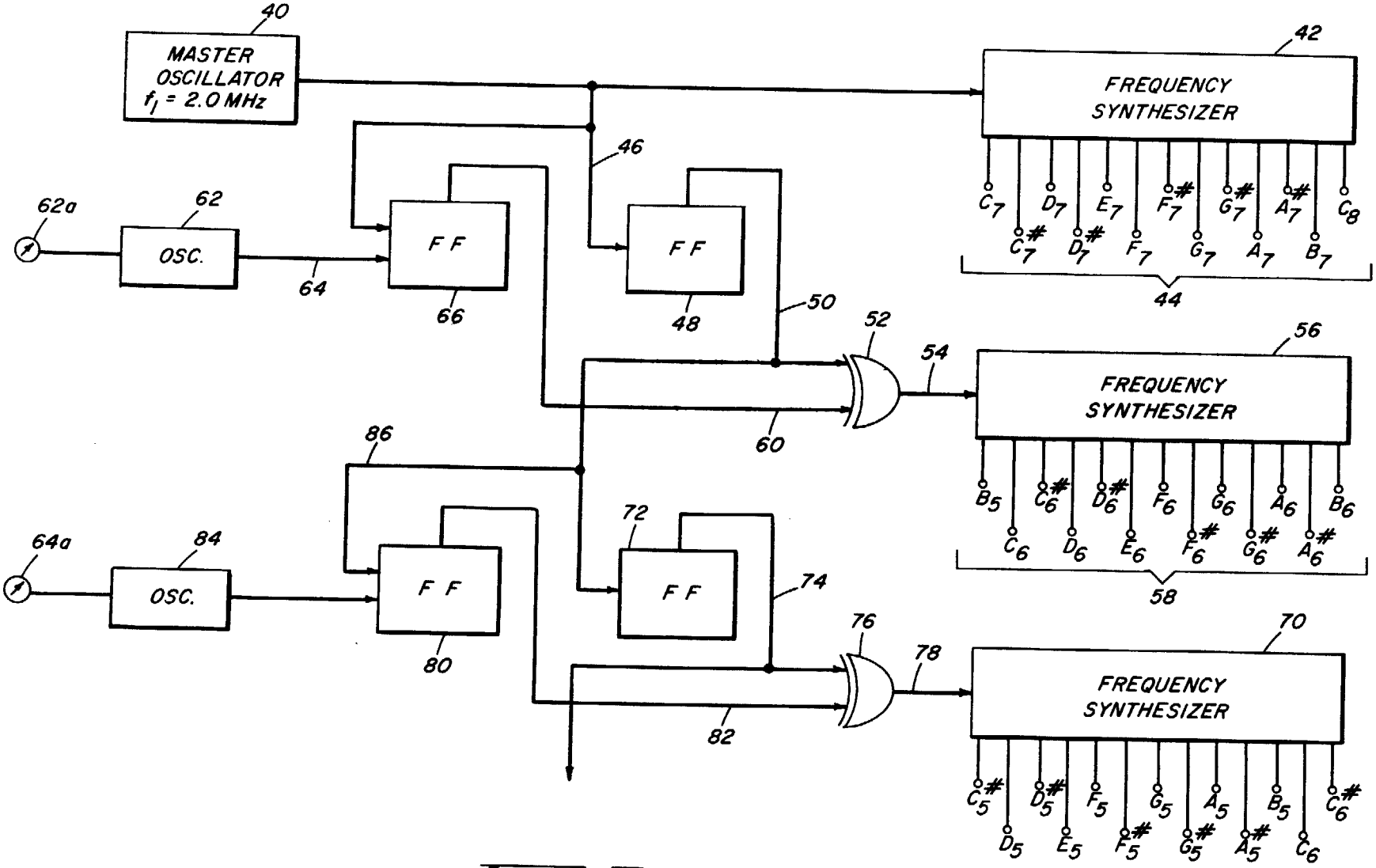
FIG. 2 is a functional block diagram of a tone generator system incorporating a second illustrative embodiment of the invention.

An alternate embodiment of the present invention is illustrated in FIG. 2. In this embodiment, the multiple master frequencies for each octave are derived from a single master oscillator, or clock 40, by dividing the frequency thereof by an appropriate factor to derive master frequencies for application to each of the other frequency synthesizers. The source 40 is conventional and its output is applied to a frequency synthesizer 42, such as the type marketed by National Semiconductor mentioned earlier. The synthesizer 42 has thirteen output lines 44, twelve of which are connected to the various keyers and other circuits of the electronic musical instrument, in order to furnish the appropriate signals to the output system of the instrument. If the frequency of the clock 40 is 2.00024 MHz (as in the system of FIG. 1), the frequencies of the outputs on lines 44 are as set forth in Table 1.

The output of source 40 is also connected by a line 46 to a flip-flop 48 which functions as a frequency divider, producing on an output line 50 a signal having a pulse repetition rate equal to half that present on line 46. The line 50 is connected to one input of an exclusive OR gate 52, the output of which is connected by a line 54 to the input of a second frequency synthesizer 56. The frequency synthesizer 56 is provided for the second highest octave and produces, on thirteen output lines 58, signals having frequencies for the second highest octave of the instrument.

The exclusive OR gate 52 operates in the conventional manner to provide a high level output on the line 54 if one and only one of its two input lines 50 and 60 is energized with a high level signal. Thus, the gate 52 functions to pass the pulses occurring on the input line 50 in unmodified form as long as a low-level input signal is applied to the other input by line 60. However, if a high-level input is applied to the line 60, the exclusive OR gate functions to invert the signals appearing on the input line 50 and produces inverted pulses on the output line 54 in response to the pulses on line 50. As used in the system, the function of exclusive OR gate 52 is to cause the average pulse repetition rate of the pulse train applied to the output line 54 to differ by a controlled amount from the average pulse repetition rate of the pulse train appearing on line 50. This is accomplished by causing the exclusive OR gate 52 to occasionally omit one of the pulses applied to its input on the line 50 from the pulse train appearing on the output line 54.

To this end, an oscillator 62 is provided to produce on an output line 64 pulses at a rate relatively low with respect to the repetition frequency of master pulse source 40. The line 64 is connected to the D input of a D type flip-flop 66, and the clock input of the flip-flop 66 is from the line 46. The flip-flop 66 passes the D input to the output coincidentally with a positive-going edge of the clock signal present on the line 46. The output of the flip-flop 66 is applied to the line 60 which, it will be recalled, is coupled to one of the inputs of the exclusive OR gate 52. In accordance with the present invention, the pulse repetition rate of the oscillator 62 is such as to cause the repetition rate of the pulse train on line 54 to differ from the rate of source 40 by a factor which differs from two by at least one semitone. If, for example, it is desired that the frequency of the pulse train applied to frequency synthesizer 56 be less by one semitone than one-half the frequency of source 40, the required frequency of oscillator 62 has been calculated to be 56,106.8 Hz.

The state of the output on line 54 is extended for an additional period equal to one-half cycle of the pulse train on line 60 each time there is a change of level of the signal on the input line 60. Accordingly, for each two changes of level of the signal (i.e., one cycle) applied to the input line 60, a pulse is dropped from the output on line 54, yielding a lower pulse repetition rate on the output line 54 than would be the case if the repetition rate of the clock pulse signal on line 50 were simply divided by two. As a result, the frequency of the pulses on the output line 54 is $$\frac{f_1}{2} \times \frac{1}{\sqrt[12]{2}}$$

which, for the illustrative case of $f_1 = 2.00024$ MHz, is equal to 0.9440 MHz. As a result, the frequency synthesizer 56, which has the same dividing factors as frequency synthesizer 42, produces signals on the output lines 58 which differ in frequency from the corresponding output signals of the synthesizer 42 by a factor differing from two by a semitone; the outputs on the lines 58 are, therefore, not locked in phase to the corresponding outputs on the lines 44. As in the system of FIG. 1, the $B_5$ tone appearing on the first of the output lines 58 would not be used, and the signals on the remaining twelve output lines applied to keyers and other circuitry of the musical instrument.

A master frequency source for application to a third frequency synthesizer 70 for producing signals having frequencies corresponding to the third highest octave of the musical instrument is obtained by connecting the output line 50 of flip-flop 48 to the input of a flip-flop 72, which functions to divide the pulse repetition rate by two and to produce, on an output line 74, a pulse train having a frequency one-fourth that of source 40. The line 74 is connected to one input of a second exclusive OR gate 76 which produces on an output line 78 a pulse train which is applied to the input of frequency synthesizer 70. As in the system of FIG. 1, the advantages of the invention are realized when the frequency of the pulse train on line 78 differs from one-fourth that of source 40 by one or more semitones in either direction; that is, the frequency of the pulse train on line 78 may be $f_1/4 \times 1.0594$, or about six percent higher than one-fourth the frequency of source 40, or it may be lower by a similar amount. In order to increase the frequency of the various outputs from frequency synthesizer 70 it is necessary to add additional pulses instead of omitting pulses; apparatus for accomplishing this is illustrated in FIG. 4 of the aforementioned U.S. Pat. No. 3,828,109 and described in Col. 6, lines 7-55. It is more costly, however, to add pulses than to drop them in that the former requires an extra clock source and two monostable multivibrators. Thus, it is generally preferable to drop pulses to reduce the frequency of the pulse train on line 78, and in the discussion to follow, it will be assumed that the frequency is reduced to $$\frac{f_1}{4} \times \frac{1}{\sqrt[12]{2}}.$$

To obtain this frequency, a second input for the exclusive OR gate 76 is connected from the output of a second D type flip-flop 80 over a line 82. The D input of the flip-flop 80 is derived from a second oscillator 84 and the clock input is connected from the line 50 over a line 86. The output of flip-flop 80 produces a signal which causes the exclusive OR gate 76 occasionally to omit a pulse from the output produced on the line 78, in the same manner as has been described in connection with the exclusive OR gate 52.

The oscillator 84 functions at a different, lower frequency than the oscillator 62; if they were of the same frequency, the frequency at which pulses are omitted from the outputs on the lines 54 and 78 would be the same, with the consequence that the deviation in frequency as a result of the pulse omissions would be twice as large on the output line 78 as on the line 54. In order to maintain approximately the same ratio between the theoretically correct frequencies applied to the frequency synthesizers and the average pulse repetition rate which results after the omission of certain pulses, the oscillator 84 should operate at a lower pulse repetition rate than the oscillator 62. Specifically, in order to obtain a pulse repetition frequency on output line 78 of $f_1/4\times0.9439$, the pulse repetition frequency of oscillator 84 should be 28,053.4 Hz. In any event, it is preferable to employ variable frequency oscillators for the oscillators 62 and 84 so that they can be manually controlled independently, so as to allow the most pleasing musical effect. The manual controls for such variable frequency oscillators are indicated by the diagrammatically illustrated controls **62*a* and 84*a* in FIG. 2**.

It will be evident that the apparatus of FIG. 2 functions similarly to the system of FIG. 1 to produce a succession of harmonically related tones for each octave of the musical instrument, each of which differs from corresponding tones in other octaves by a factor differing from two by one or more semitones, to randomize temperament errors and thereby to produce a chorus effect when a plurality of corresponding tones are reproduced simultaneously in the output system of the instrument.

Although the invention has been described as applied to the randomizing of temperament errors among the different octaves of a single keyboard, its principles are readily applicable to larger organ systems containing a plurality of generator systems each organized as shown in FIG. 1, for example, one for each of the two keyboards of a two-manual organ, or one tone generator system for supplying the tones of some voices and another supplying the tones of other voices.

All of the master oscillators are operated independently and not in synchronism with other oscillators, with the consequence that tone pitches in different octaves are not in locked phase relationship, and temperament errors can be randomized among unisonally-related generators.

In the above description of illustrative embodiments, it has been stated that the desired randomization of temperament errors is achieved by using master frequency sources for successive octaves which differ in frequency by a factor which differs from two by one or more semitones. In some cases, however, improved chorus effects are produced when the nominal semitone deviation is increased or decreased by up to about one-half percent. It is intended, therefore, that the term "semitone" as used in the claims shall include such deviations from a nominal semitone.

Also, as used in the claims, the term "clock pulses" is intended to characterize the output signal produced by the master oscillators, be it a train of pulses or a sinusoidal signal.

The above teaching of the principles of the invention will suggest to ones skilled in the art various modifications to the illustrative embodiments and applications of the invention to systems other than those illustrated without departing from the spirit of the invention. The specific internal construction of the various frequency synthesizers form no part of the present invention which, as has been stated, is directed to the disclosed combination and interconnection of master frequency sources and frequency synthesizer units. Any well-known and conventional frequency synthesizer can be used, the dividing factors of which can be selected at will in conventional fashion. For example, those commercially available frequency synthesizers having the capability of producing but six output signals per integrated circuit package can be arranged in different ways, depending on their dividing factors, to obtain the desired twelve notes for each octave. Further, the master oscillator frequencies specified in the description are by way of illustration, and others may be selected in conventional fashion as a function of dividing factors of the selected frequency synthesizer. It is to be understood that we wish to include within the scope of the appended claims all such modifications as reasonably and properly come within the scope of our contribution to the art.

We claim:

1. A tone generator system for an electrical musical instrument, said system comprising, at least first and second frequency synthesizers, one for each of two related octaves, each having an input terminal and a plurality of output terminals, and each being operative to divide the frequency of a signal of appropriate frequency applied to its input terminal to produce at its output terminals a like plurality of pitches corresponding to different notes of the musical scale, said at least first and second frequency synthesizers having like frequency dividing factors associated with like output terminals so as to be operative in response to application thereto of input signals of the same frequency to produce the same pitches at corresponding output terminals thereof, a first source of clock pulses connected to the input terminal of said first frequency synthesizer, said first source having a frequency to produce at a given plurality of the output terminals of said first synthesizer a like plurality of notes of the musical scale in one octave, which notes inherently have slight errors in frequency from corresponding notes of the true equitempered scale which differ in sense and degree from note to note as a function of its frequency dividing factors, and a second source of clock pulses connected to the input terminal of said second frequency synthesizer, the frequency of said second source differing from the frequency of said first source by a factor which differs from a power of two by one or more nominal semitones such that said second frequency synthesizer is operative in response to clock pulses from said second source to produce at the plurality of output terminals of said second synthesizer corresponding to the said given plurality of output terminals of said first synthesizer, a like plurality of notes in a related octave which individually are octavely unrelated to the notes produced at like output terminals of said first synthesizer, which notes also inherently have slight errors in frequency from the true equitempered scale which differ in sense and degree from note to note, with the error from true equitemperament appearing at a given output terminal of said second synthesizer being of the same sense and magnitude as the error from true equitemperament appearing on the corresponding output terminal of said first synthesizer, whereby, because different notes appear on corresponding output terminals of said first and second frequency synthesizers, temperament interval errors inherent in said first and second frequency synthesizers are randomized.

2. A tone generator system according to claim 1, wherein said related octaves are successive octaves, and wherein the frequency of said second source of clock pulses differs from the frequency of said first source by a factor which differs from two by one or more semitones.

3. A tone generator system according to claim 2, wherein the frequency of said second source of clock pulses is higher by one or more semitones than one-half the frequency of said first source.

4. A tone generator system according to claim 2, wherein the frequency of said second source of clock pulses is lower by one or more semitones than one-half the frequency of said first source.

5. A tone generator system according to claim 1, wherein said first and second sources of clock pulses are independent master oscillators.

6. A tone generator system according to claim 2, wherein said first and second sources of clock pulses are independent master oscillators.

7. A tone generator system according to claim 2, wherein said second source of clock pulses includes first frequency divider means connected to said first source for dividing the frequency of the clock pulses from said first source by a factor which differs from two by one or more semitones, and means connecting said first frequency divider means to said second frequency synthesizer.

8. A tone generator system according to claim 7, wherein said system further comprises a third frequency synthesizer having an input terminal and a plurality of output terminals and having the same frequency dividing factors associated with like output terminals as said first and second frequency synthesizers, second frequency divider means connected to said first frequency divider means for dividing the frequency of the clock pulses produced by said first frequency divider means by a factor which differs from two by one or more semitones, and means connecting said second frequency divider means to said third frequency synthesizer, said third frequency synthesizer being operative in response to clock pulses produced by said second frequency divider means to produce at the output terminals thereof corresponding to the said given plurality of output terminals of said first and second frequency synthesizers a like plurality of notes in the octave next lower than that produced by said second frequency synthesizer which individually are octavely unrelated to the notes produced at like output terminals of said first and second frequency synthesizers, which notes also inherently have slight errors in frequency from the true equitempered scale which differ in sense and degree from note to note, with the error from true equitemperament appearing at a given output terminal of said third synthesizer being of the same sense and magnitude as the error from true equitemperament appearing at the corresponding output terminals of said first and second synthesizers.

* * * * *